US011814141B2

(12) United States Patent
Roller

(10) Patent No.: US 11,814,141 B2
(45) Date of Patent: Nov. 14, 2023

(54) BOAT TIE DOWN APPARATUS

(71) Applicant: Michael L. Roller, Purdy, MO (US)

(72) Inventor: Michael L. Roller, Purdy, MO (US)

(73) Assignee: Michael L. Roller, Purdy (MC)

( * ) Notice: Subject to any disclaimer, the term of this patent is extended or adjusted under 35 U.S.C. 154(b) by 447 days.

(21) Appl. No.: 16/501,063

(22) Filed: Feb. 18, 2019

(65) Prior Publication Data

US 2019/0263478 A1 Aug. 29, 2019

Related U.S. Application Data

(60) Provisional application No. 62/710,678, filed on Feb. 23, 2018.

(51) Int. Cl.
*B63B 21/20* (2006.01)
*B63B 21/00* (2006.01)

(52) U.S. Cl.
CPC ..... *B63B 21/20* (2013.01); *B63B 2021/004* (2013.01)

(58) Field of Classification Search
CPC .... B63B 2021/004; B63B 21/54; B63B 21/20
See application file for complete search history.

(56) References Cited

U.S. PATENT DOCUMENTS 2,558,174 A 6/1951 Flink
2,704,052 A * 3/1955 Wood ..... A01K 15/003 43/87
3,224,404 A * 12/1965 De Jong ..... B63B 21/54 114/230.25
3,330,244 A 7/1967 Page
3,861,346 A 1/1975 Pina
3,878,808 A * 4/1975 Mock, Jr. ..... B63B 21/54 114/230.25
3,945,335 A 3/1976 Kratz
3,993,013 A 11/1976 Nunziato et al.
4,041,887 A 8/1977 Paul
4,073,255 A 2/1978 Paul
4,109,603 A * 8/1978 Guthmann ..... B63B 21/00 114/218
4,143,613 A 3/1979 Paul
(Continued)

FOREIGN PATENT DOCUMENTS

GB 2426965 A * 12/2006 ..... B63B 21/54
WO WO 2005/077749 A1 8/2005
(Continued)

*Primary Examiner* — Anthony D Wiest
(74) *Attorney, Agent, or Firm* — Armstrong Teasdale LLP

(57) ABSTRACT

A boat tie down apparatus including a tubular member, the tubular member has a length that provides for the displacement of a boat from the dock during mooring, the tubular member has a rope extending therethrough, the front end of the rope extends out the front of the tubular member, and locates approximate the front end of the tubular member, to form a variable sized loop, for securement over a cleat or other structure at the dock. The back end of the rope, that extends through the tubular member, can be pulled for tightening the apparatus to the dock, and then the back end of the rope can be tied to a structure on the boat, such as a cleat, to provide for securement of the boat to the dock, displaced from the dock, during its mooring.

8 Claims, 3 Drawing Sheets

(56) References Cited

U.S. PATENT DOCUMENTS

| | | | | |
|---|---|---|---|---|
| 4,686,926 | A | 8/1987 | Vance | |
| 4,697,538 | A | 10/1987 | Day | |
| 4,912,816 | A * | 4/1990 | Brandt | B63B 21/00 114/230.26 |
| 5,429,063 | A | 7/1995 | Rosenkranz | |
| 5,542,367 | A | 8/1996 | DuBois, III et al. | |
| 5,575,234 | A | 11/1996 | Dysarz | |
| 5,694,879 | A | 12/1997 | Taylor | |
| 5,799,602 | A | 9/1998 | Trillo | |
| 5,832,861 | A | 11/1998 | Taylor | |
| 6,032,604 | A | 3/2000 | Will | |
| 6,109,198 | A | 8/2000 | Hinz | |
| 6,119,616 | A | 9/2000 | Hannasch | |
| 6,647,911 | B1 | 11/2003 | Solterbeck | |
| 6,786,168 | B1 | 9/2004 | Foster | |
| 6,925,951 | B1 | 8/2005 | DeLong | |
| 6,928,945 | B1 | 8/2005 | Tebo, Jr. | |
| 6,962,122 | B1 | 11/2005 | Bouldin, Jr. | |
| 6,978,730 | B1 | 12/2005 | McCarthy | |
| 7,784,418 | B2 | 8/2010 | Hall | |
| 8,082,868 | B1 | 12/2011 | Johnson | |
| 8,176,878 | B1 * | 5/2012 | Wexler | A01K 25/00 119/174 |
| 8,567,334 | B1 | 10/2013 | Matlin et al. | |
| 8,601,968 | B1 | 12/2013 | Ansel, Jr. | |
| D697,469 | S | 1/2014 | Stanley | |
| 8,646,398 | B1 | 2/2014 | Ansel, Jr. | |
| 8,763,550 | B1 | 7/2014 | Matlin et al. | |
| 9,045,198 | B2 | 6/2015 | Philips | |
| D755,611 | S | 5/2016 | Underwood | |
| 2002/0152944 | A1 | 10/2002 | Ryan | |
| 2004/0194685 | A1 | 10/2004 | Slater | |
| 2005/0061225 | A1 | 3/2005 | Metz | |
| 2005/0172879 | A1 | 8/2005 | DeLong | |
| 2010/0107954 | A1 | 5/2010 | Hall | |
| 2010/0229776 | A1 | 9/2010 | Hall | |
| 2012/0152161 | A1 * | 6/2012 | Stanley | B63B 21/54 114/230.1 |
| 2012/0228891 | A1 * | 9/2012 | Howard | B63B 21/04 294/191 |
| 2014/0069312 | A1 | 3/2014 | Pease, Jr. et al. | |
| 2015/0075416 | A1 | 3/2015 | Salt | |
| 2017/0080994 | A1 * | 3/2017 | Garcia | B63B 21/00 |

FOREIGN PATENT DOCUMENTS

| | | | |
|---|---|---|---|
| WO | WO 2005/115829 | A1 | 12/2005 |
| WO | WO 2011/060007 | A1 | 5/2011 |
| WO | WO 2012/150950 | A1 | 11/2012 |

* cited by examiner

BOAT TIE DOWN APPARATUS

CROSS REFERENCE TO RELATED APPLICATION

This application is a non-provisional application of the provisional application having Ser. No. 62/710,678 filed on Feb. 23, 2018.

FIELD OF INVENTION

This invention relates to means for anchoring a boat at the dock, or at other locations, and more specifically pertains to a tie down apparatus that can be secured to the cleat or other fastening means provided upon a dock, without having to exit the boat and on to the dock, but can be applied from a standing position within the boat, and once secured to the dock, can be fastened to any cleat or other fastening device associated with the side or gunnel of the boat, to secure it during docking.

BACKGROUND OF THE INVENTION

As stated, this invention relates to a means for tying a boat to a dock, or other facility, and which can be achieved from maintaining a position within the boat, to secure its complete attachment during mooring.

Usually, in the prior art, the way to anchor a boat to a dock, or other means of securement, is to initially secure the anchoring rope to the boat, and then jump from the boat onto the dock, to fasten the tie down rope to a cleat or other means of securement, furnished at the dock. As can sometimes occur, if the boat begins to move away from the dock, and the individual jumps onto the dock, slippage can occur, which means the person may fall on the dock, particularly if it is wet, or sometimes into the water, which has on occasion occurred. And, some folks have a tie rope that is secured into the gunnel of the boat, and can be pulled up with some resistance, and then the operator can jump onto the dock, to tie the end of the rope to a cleat, or other means for fastening. These are examples of the types of tie downs that currently are available in the art.

In addition, there are some patents on various types of boat tie down devices, and these can be seen in the various United States patents referred to herein.

The foregoing provides what is believed to be the current state of the art, with regard to devices for tying a boat to the dock, or other structure, when the boat is to be moored.

SUMMARY OF THE INVENTION

This invention contemplates a unique apparatus, that can be used for tying a boat to a dock, where the operator need not remove himself/herself from the boat, to attain a complete securement of the boat to a dock, or other structure.

Essentially, this invention relates to the application of the longitudinal tube, that has a loop formation at its forward end, formed by a length of rope or cable, where the loop can be expanded, for the user to reach from side of the boat and to the dock to secure the tie down loop onto a cleat, provided on the dock, and then pull the other end of the rope that extends from the back end of the longitudinal cylinder, to secure tightly the loop onto the dock cleat, and then said opposite end of the rope can be secured to the boat, whether it be a cleat on the boat, or other structure to which a securement rope can be tied, during mooring of the boat. During all this usage, in the application of the tie down device for securement of the boat, the user can remain within the boat, to both secure the tie down to the dock, and also to the boat, without having to jump onto the dock, during performance of such a procedure.

Furthermore, another benefit of this invention is that the cylindrical member forming the tube of the tie down device, has length, in a preferred embodiment approximately sixteen inches in length, although it can be to other dimensions, whether it be one foot, and up to as much as 45 inches, or more, in its structure.

Thus, this provides a fixed structure that can keep the boat a related fixed distance from the dock, so the side of the boat does not excessively rub against the edge of the dock, which can cause abrasion or scratching to the boat, during its period of mooring.

Furthermore, the structure of this tie down apparatus includes a handle portion, applied to the back end of the tubular member, and which provides a significant grip, that prevents slippage of the apparatus from the hand of the user, since there may be instances when this apparatus may be wet, either from lake or river water, or from weather conditions, and it is desirable to provide a means for furnishing a frictional gripping surface, that allows the user to hold fast to the apparatus, during its maneuvering in tying down the boat with the dock, during usage.

The formation of the loop at the front end of the tubular structure of the apparatus is formed by the extension of the flexible rope from the approximate end of the member, while the rope forming the loop may then extend through an aperture provided somewhat rivertly, in order to furnish an automatic formation of the loop, for the rope, to allow it to easily be maneuvered onto a dock cleat, during its application, at which time, since the other end of the rope that extends through the tubular member, and out its back end, that end of the rope can be pulled tightly, to secure the apparatus loop onto the dock cleat, before that back end of the rope is secured to the boat, during its application.

It is, therefore, a principle logic of this invention to provide a tie down apparatus for a boat, which can be utilized by the operator while standing throughout the tie down usage within the boat and not having to jump onto the dock, to secure the mooring rope in place.

Another object of this invention is to provide a tie down apparatus that forms an adjustable loop, at its forward end, to allow the operator to secure it onto the cleat of a dock, during its usage.

Another object of this invention is to allow the operator to utilize a boat tie down apparatus that can be pulled tightly, while the operator stands in the boat, to secure the forward end of the tie down device, and its loop, tightly to a dock cleat, during its application.

Another object of this invention is to provide a tie down apparatus for a boat, wherein the back end of its rope, extending from its tubular member, can be pulled tightly, to provide sufficient length of rope to allow its back end to be secured to the boat, to complete its docking.

Still another object of this invention is to provide a boat mooring device that incorporates a fixed structural tubular member, that can keep the boat at some distance from the dock, to prevent the side of the boat from rubbing against the dock, as due to water wave action, while the boat is moored into position at the dock.

These and other objects and purposes of this invention may become more apparent to those skilled in the art upon reviewing the summary of the invention herein, and upon taking a study of the description of its preferred embodiment, in view of the drawings.

BRIEF DESCRIPTION OF THE DRAWINGS

In referring to the drawings, FIG. 1 provides a partial view of the gunnel of a boat, and a dock, showing the tie down apparatus of this invention during usage, when applied into a cleat upon the dock.

DESCRIPTION OF THE PREFERRED EMBODIMENT

This invention contemplates an improvement to the fastening of a boat, to a dock, or other location, and more specifically to a structured apparatus, incorporating a longitudinal cylinder, cooperating with a tie down rope, that can secure the boat to the dock, with some displacement maintained between the dock and the boat, so an operator that remains within the boat during the entire securement process.

Figure 1:
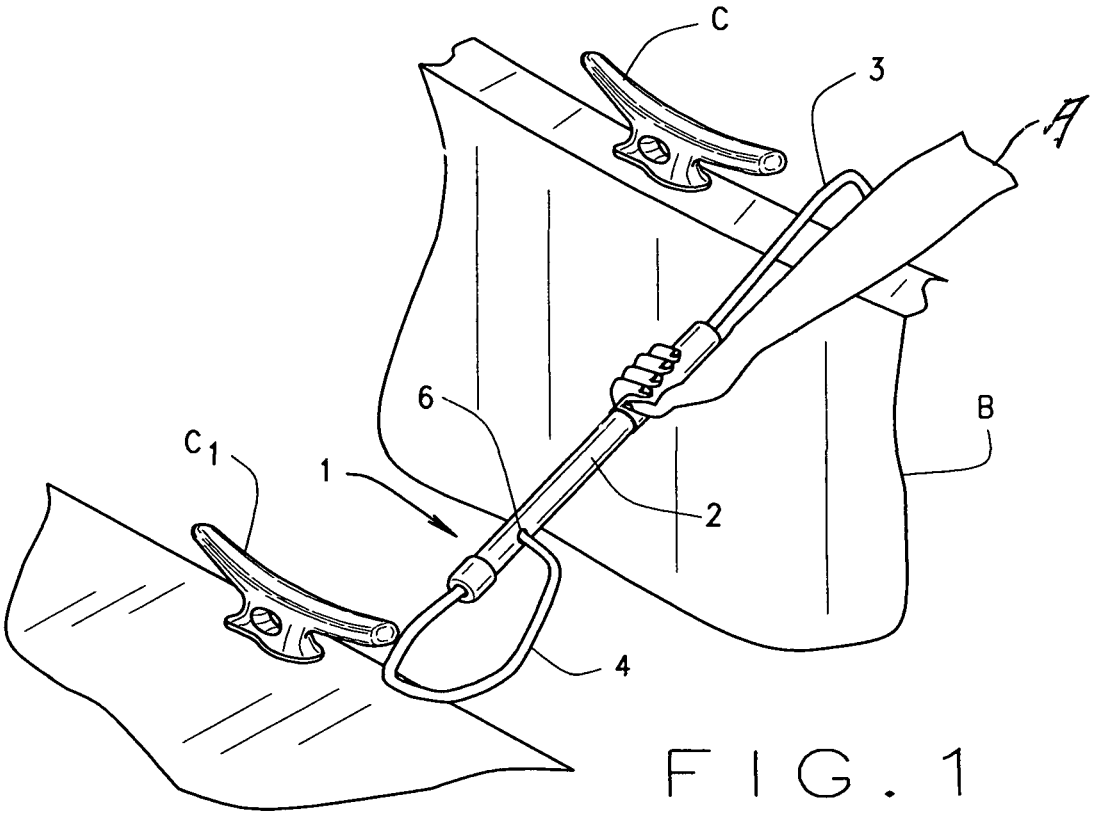
Figure 2:
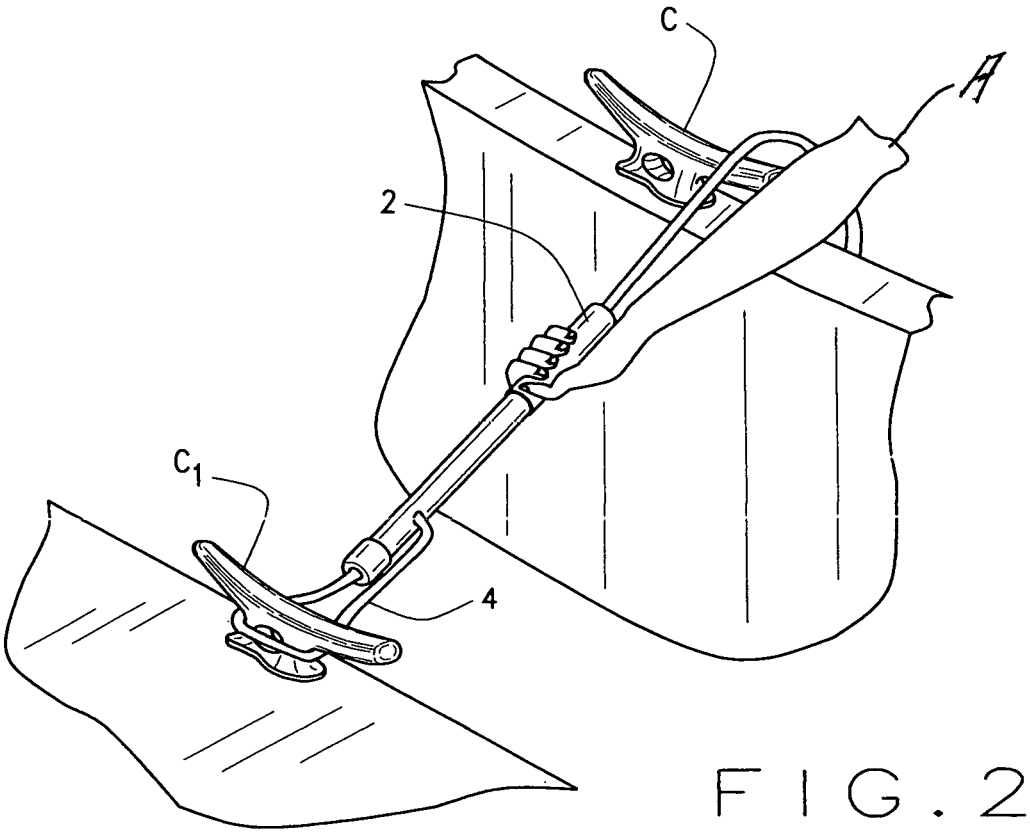
FIG. 2 provides a similar view to that of FIG. 1, but showing how the loop at the end of the tie down apparatus can be secured tightly to the cleat o the dock.

As can be seen in FIG. 1, there is shown a partial view of a side of a boat, as noted at B, generally forming a gunnel of the boat, and upon the top surface of the side of the boat may be a fastening device, such as a cleat C, as can be noted. Likewise, the edge of the dock has usually a cleat C1 provided attached thereto, as seen, and the concept is to tie the boat to the dock during its mooring. To do this, the boat tie down apparatus 1 in this invention can be seen as including a length of tubular cylinder, 2, of any shape, and which has a continuous rope 3 extending there through, and where it extends out the front of the tubular member, can be formed into a configured loop, as noted at 4, with the rope then extending through an aperture 6, and being secured within the tube, either by a knotted end, or other means for fastening, to maintain that forward and up the rope secured within or to the tubular structure, during its assembly. Then, the loop 4 can be pulled open, which pulls some of the rope 3 through the tube, to form the type of loop forward, as noted in FIG. 2, that can be secured over the cleat C1, of the dock, to initiate the mooring process. All this can be done by the user of the device, with an arm A and B shown, while the user remains standing in the boat, throughout the entire tie down process.

Figure 8:
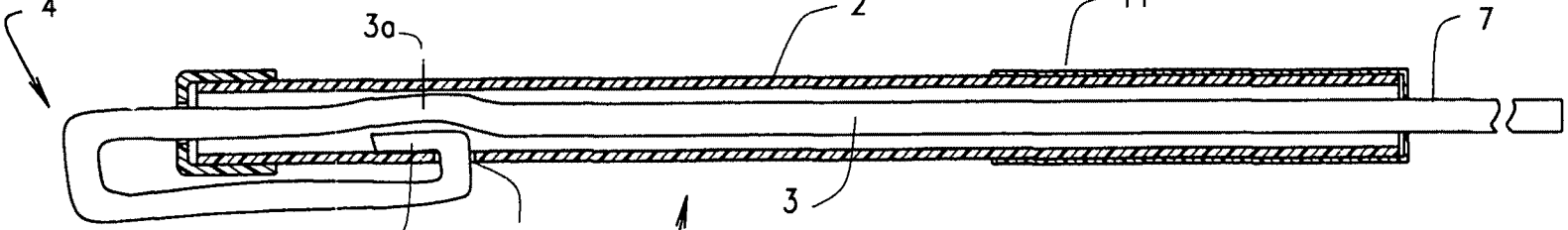
FIG. 8 is a longitudinal sectional view of the tie down apparatus taken upon the line 8-8 of FIG. 5.

The tying of the forward end of the rope 3, within the tube, can be seen at 5 in FIG. 8, and there can be either a knotted end at that location, to prevent the rope from exiting the shown aperture, at the location of 6, or other means for securement, whether it be a staple, link, or any other similar device that prevents that end of the rope from exiting the interior of the shown tubular member 2, as noted.

Figure 3:
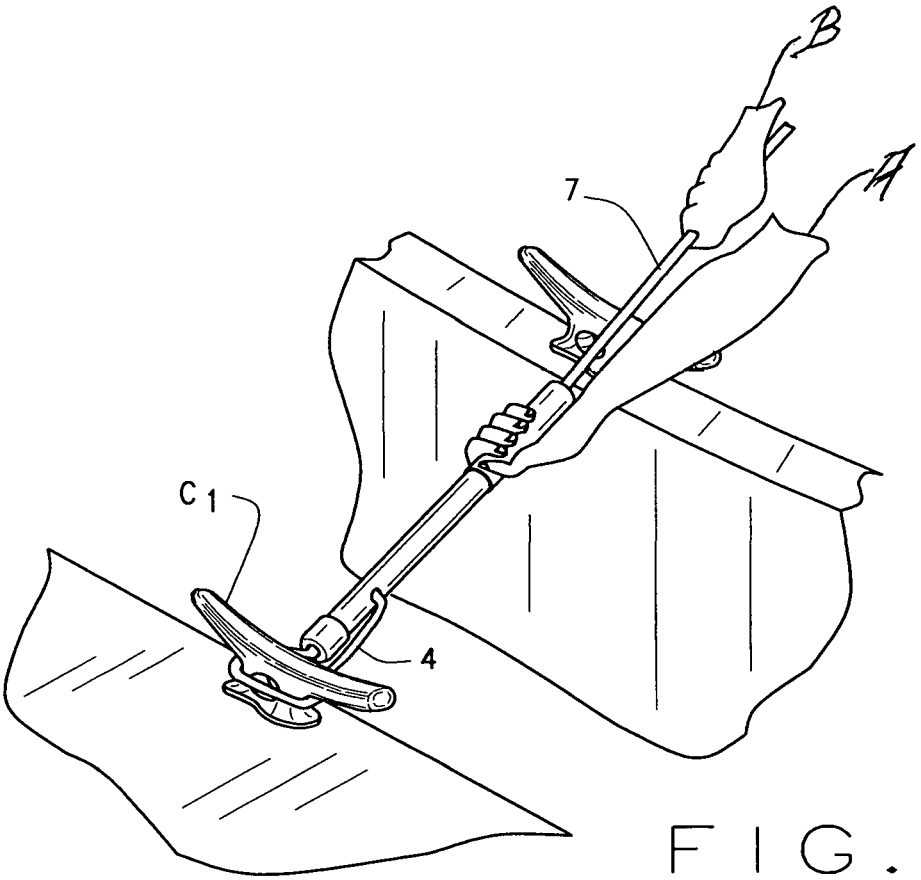
FIG. 3 shows how the opposite and back end of the rope can be pulled tightly, for securement of the tie down apparatus to the dock cleat.

As can be seen in FIG. 3, once the loop 4 is secured to the cleat C1 of the dock, the user then pulls upon the back end of said rope, as at 7, to tighten the loop 4 about the cleat, as noted. At that time, the user can then tie the excess rope 7 about the boat cleat C, or other related structure, to secure the entire tie down apparatus in place, and to properly moor the boat into position, slightly displaced from the dock, as can be seen.

There are two features of the foregoing that need to be mentioned, initially, as stated, the user, during performance of this entire procedure, remains in the boat, and need not jump onto the dock, to tie any rope onto the cleat C1. Secondly, as can been seen in FIG. 4, once the tie down apparatus has secured the boat in position, relative to the dock, the fixed length of the tubular member 2 displaces the boat for some slight distance away from the dock, so that the wave action of the water, whether it be a river or lake, does not force the boat against the dock, which may abrasively damage the surface of the boat, during mooring.

Figure 5:
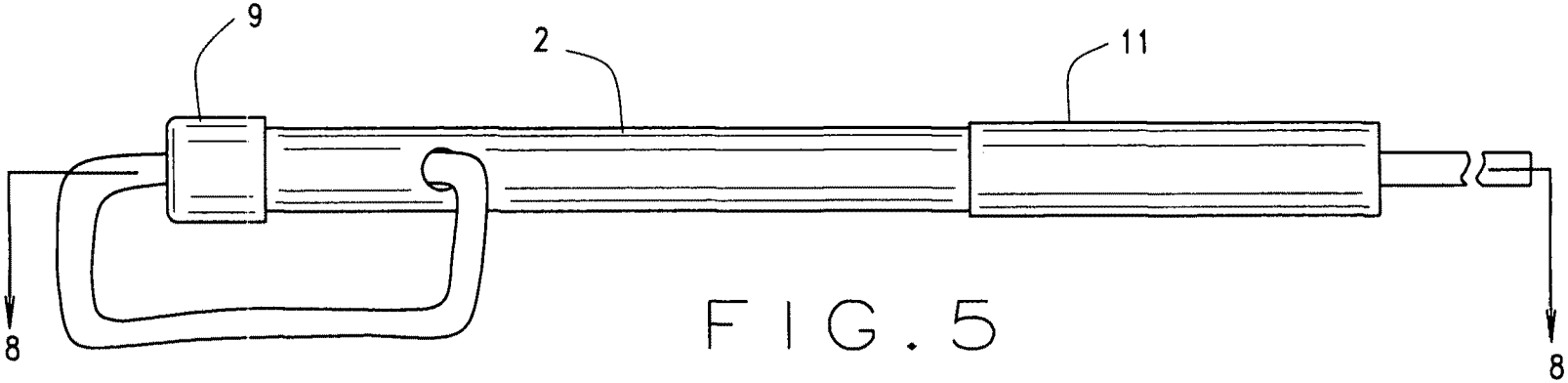
FIG. 5 shows a side view of the tie down apparatus of this invention.
Figure 7:
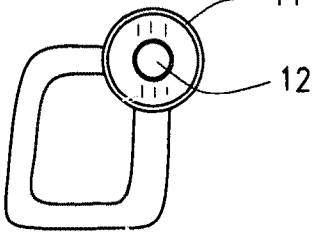
FIG. 7 shows a back end view of the tie down apparatus of this invention.
Figure 6:
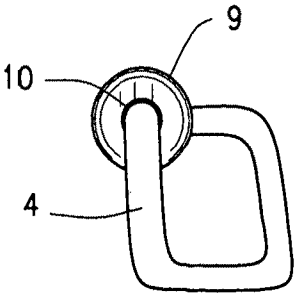
FIG. 6 provides a front end view of the tie down apparatus of this invention.

FIG. 5 provides a side view of the tie down apparatus of this invention. The tubular member 2 can be seen, and there is a forward end cap 9 that is secured thereto, whether it be formed of rubber, polymer, or the liking, which is snugly fitted on that end of the tubular member, as noted. The end cap 9 has an aperture 10 provided there-through, and it is through this end that the length of the rope extends, at its forward end, as to be noted. This is what forms the loop 4 for the forward end of the rope. Then, as previously stated, the front end of the rope, as at 5, extends through the aperture 6, of the tubular member, and is secured within the tube, to fix it into position. Thus, the rope, at 4, can be pulled forwardly, through the tube, to enlarge the form to loop, as can be noted in FIG. 1, and then when the rope is pulled tight, as noted in FIG. 3, the loop condenses, and secures onto the cleat C1, to fasten the tie down apparatus to the dock, as noted.

The back end of the tubular member 2 has a gripping device 11, and that is formed of any type of frictional surface, whether it be rubber, polymer, or any other material, that may add to the gripping aspects of the device, at that location, during its usage. As previously explained, since the boat is on water, there may be instances when the tie down apparatus may be wet, or if it is inclement weather, and the tubular member and its grip is wettened, this assist the user in sustaining a grip of the apparatus, during its application.

Figure 4:
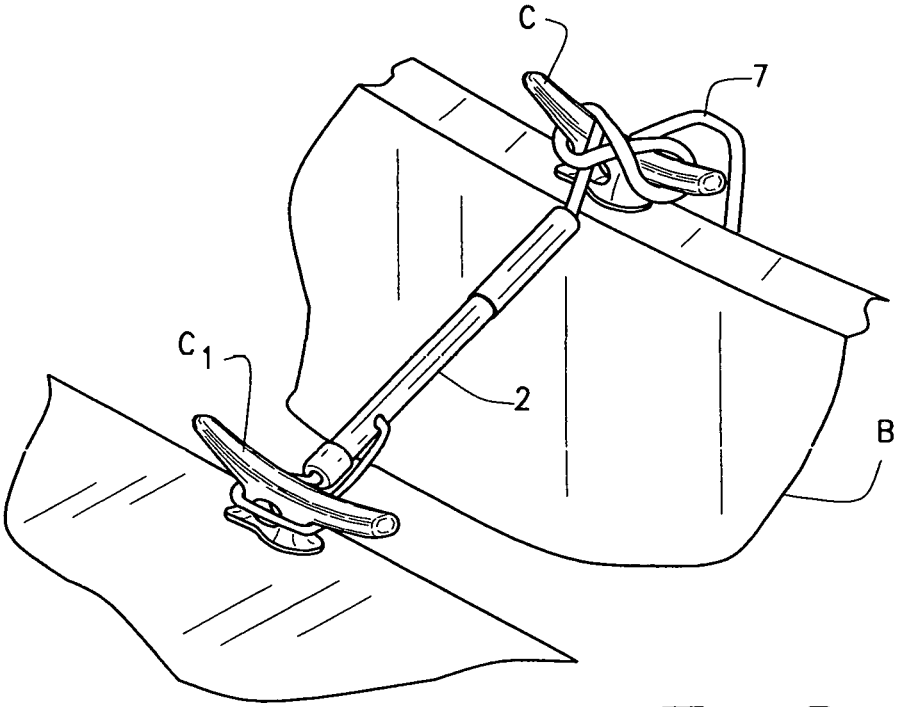
FIG. 4 shows a similar view where the back end of the rope of the tie down apparatus is secured onto a cleat or other structure furnished upon the side of the boat.

The back end of the grip 11 has an aperture 12 provided there through, and as noted in FIG. 8, it can be seen that the rope 3 extends out of the back end of the tubular member, as noted at 7, and extends for some length, generally to that as shown in FIGS. 3 and 4, to provide sufficient length of rope for tying to a structure on the boat, such as the cleat C, where the apparatus is fully tied in place, securing the boat to the dock, as can be understood. Part of the rope 3*a* bypasses that part of the rope that confines the end of the rope 5 within the tubular member 2.

When tied in position, as noted in said FIG. 4, it can be seen that the fixed length of the tubular member provides for a slight displacement of the boat, from the dock, that prevents the boat from impacting against the dock, and thereby prevents any damage to the side of the boat B, as can be understood.

Variations or modifications to the subject matter of this invention may occur to those skilled in the art upon review of the tie down apparatus of this invention. Such variations, within the spirit of this invention, are intended to be encompassed within the scope of any claims to bad protection issuing herein. The review of the invention and the summary, and its definition in the description of the preferred embodiment, and as depicted in the drawings, are primarily set forth for illustrative purposes only.

I claim:

1. A boat tie down apparatus, consisting of:

a tubular member comprising a front end and a back end opposite the front end, wherein the tubular member includes an aperture proximal to the front end; and a rope extending freely through the tubular member throughout an entirety of operation of the boat tie down apparatus, wherein the rope comprises a first end extending out of the front end of the tubular member in a first direction and a second end extending out of the back end of the tubular member in a second direction opposite the first direction, wherein the first end of the rope re-enters the tubular member through the aperture and is secured to the tubular member at a fixed end point by a knot positioned within the tubular member to form a loop, the loop extending out of the front end of the tubular member in the first direction and back into the tubular member through the aperture in a third direction perpendicular to the first direction in a perpetually open loop arrangement, and wherein the second end of the rope can be pulled through the tubular member in the second direction to contract the loop and guided back through the tubular member in the first direction to freely expand the loop for uninterrupted traversal of the rope in both the first direction and the second direction throughout the entirety of operation of the boat tie down apparatus.

2. The boat tie down apparatus of claim 1, wherein the loop can be contracted around an attachment structure of a boat dock.

3. The boat tie down apparatus of claim 1, wherein the second end of the rope extending out the back end of the tubular member can be secured to an attachment structure of a boat.

4. The boat tie down apparatus of claim 1, wherein the tubular member displaces a side of a boat from a dock.

5. The boat tie down apparatus of claim 1, further comprising an end cap at the front end of the tubular member through which the first end of the rope extends.

6. The boat tie down apparatus of claim 1, further comprising a grip at the back end of the tubular member through which the second end of the rope extends.

7. The boat tie down apparatus of claim 6, wherein the grip comprises rubber.

8. The boat tie down apparatus of claim 6, wherein the grip comprises polymer.

* * * * *